United States Patent [19]

Derman

[11] Patent Number: 5,052,199

[45] Date of Patent: Oct. 1, 1991

[54] CLAMP LOCKING DEVICE FOR PC'S AND THE LIKE

[76] Inventor: Jay S. Derman, 1201 N. Catalina Ave., Redondo Beach, Calif. 90277-0949

[21] Appl. No.: 621,222

[22] Filed: Nov. 30, 1990

[51] Int. Cl.[5] ..... E05B 73/00

[52] U.S. Cl. ..... 70/58; 70/19

[58] Field of Search ..... 70/58, 57, 19, 163, 70/164, 166-173

[56] References Cited

U.S. PATENT DOCUMENTS

| | | | |
|---|---|---|---|
| 4,553,414 | 11/1985 | Caputo | 70/58 |
| 4,656,848 | 4/1987 | Rose | 70/58 |
| 4,959,979 | 10/1990 | Filipow | 70/58 |

*Primary Examiner*—Robert L. Wolfe

*Attorney, Agent, or Firm*—Monty Koslover Assoc.

[57] ABSTRACT

A clamp device for securing the housing of PC's and similar equipment to a desk or table so that it can not be moved or stolen. The device is shaped to fit on the PC housing. Clamp pieces at the rear are made to grip the PC at its back by insertion of a wrench or screwdriver in sockets which drive threaded rods. Rotation of the rods causes the rear clamps to move forward or rearward. A key locking means at the front of the device, is used to block access to the clamp adjustment sockets, preventing the clamp from being removed from the PC. In addition, provision is made for insertion of blocking bars in the device frame, so that access to the PC disk drives can be denied.

16 Claims, 2 Drawing Sheets

Fig. 1.
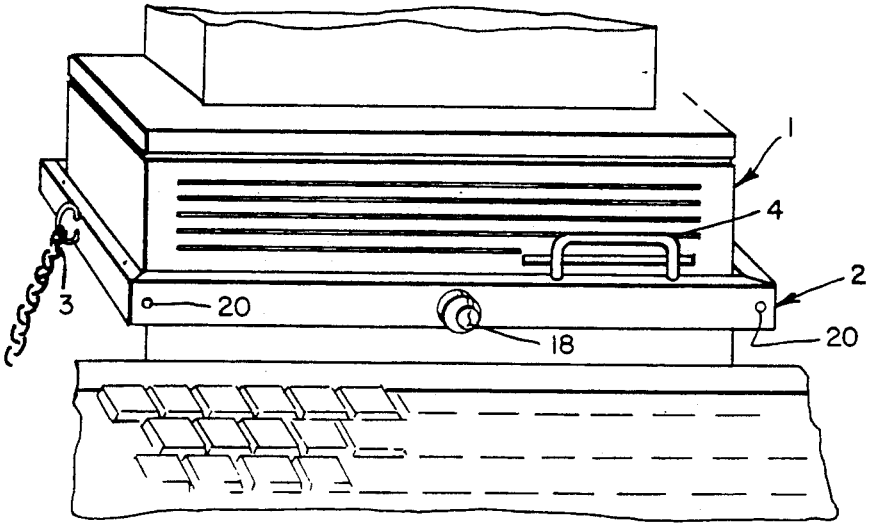
Fig. 2.
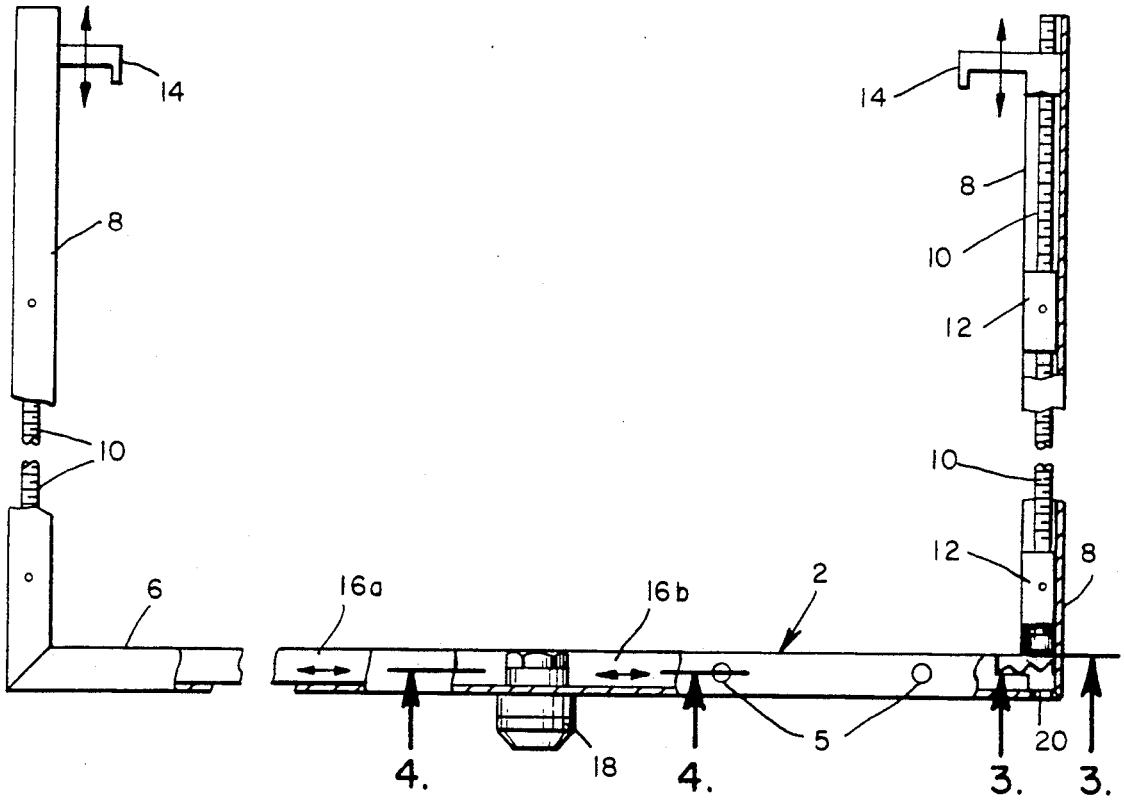
Fig. 4.
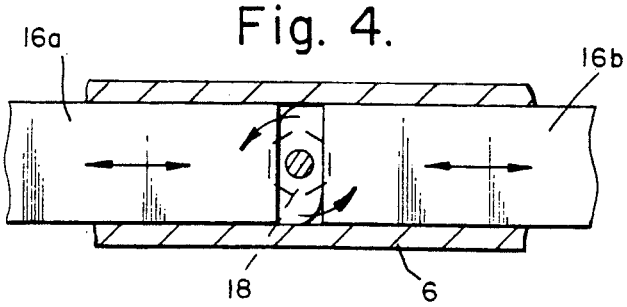
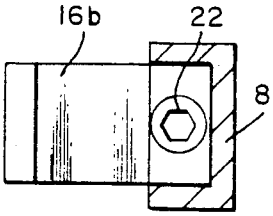
Fig. 3.

Fig. 4a.
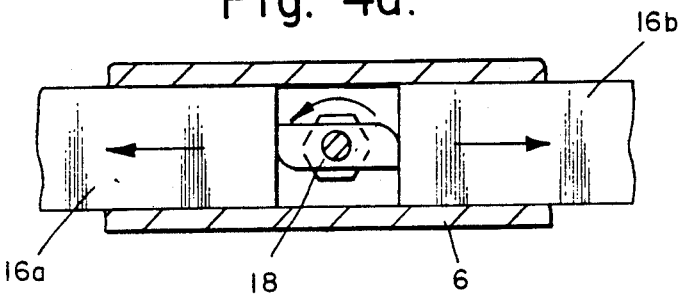
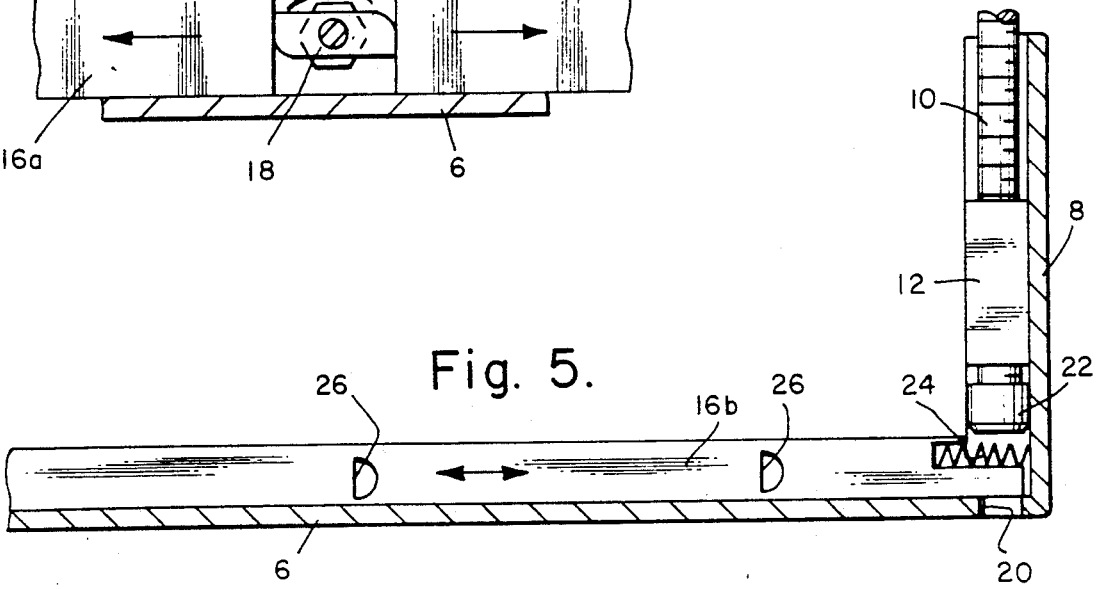
Fig. 5.
Fig. 5a.
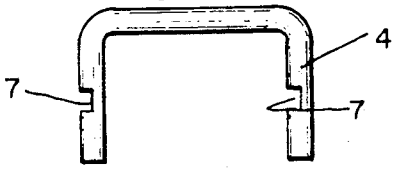
Fig. 6.
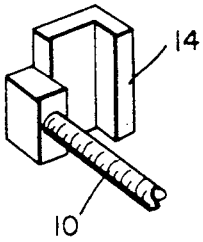
Fig. 7.
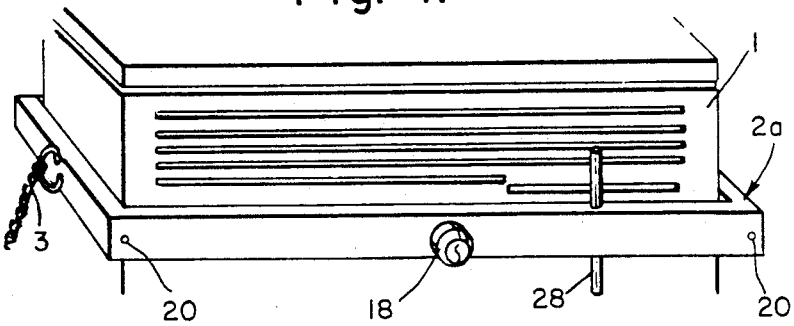
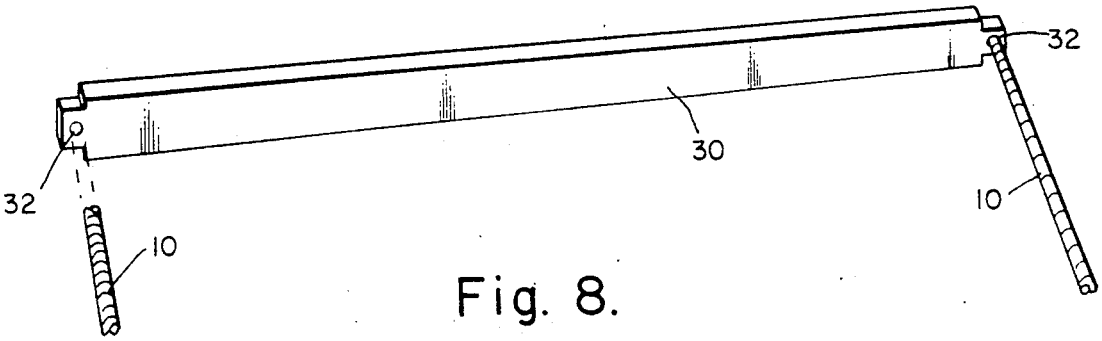
Fig. 8.

CLAMP LOCKING DEVICE FOR PC'S AND THE LIKE

BACKGROUND OF THE INVENTION

1. Field of the Invention

This invention relates to locking devices used for securing personal computer (PC) equipment and similar equipment.

2. Description of the Prior Art

There are currently a number of devices available for securing a PC to a desk or table so that it can not be moved or stolen. A typical computer products catalog shows devices that incorporate plates which are screwed on or glued to the PC housing. Attached to each plate is a cable or chain which is then secured by a padlock to the desk or table. Other devices include brackets of varying shapes which, like the plate, are screwed on to the back or side of the PC housing and may have a cable or chain attached. Some bracket devices also secure the PC back panel, preventing its easy removal and stealing of computer printed circuit boards.

In all the above devices, it is apparently assumed that the PC owner will not wish to remove the device from the PC, once it is installed. The glued plates do not lend themselves to removal, and the screwed on installations can be difficult to reach, particularly those at the back plate.

In view of the above, there is a need for a PC locking device which will prevent stealing the PC or removal of its back plate, while being easy for the owner to install and remove it.

SUMMARY OF THE INVENTION

The embodiment is a clamp device, shaped to fit on the PC housing and made to grip the PC tightly from all sides. The back grip may be in the form of two separate clamp pieces, one at each of the PC back plate edges, or a single bar across the back plate. The rear clamp pieces or bar are tightened or loosened by insertion of a wrench in sockets at the front of the clamp, and turning the wrench. A threaded rod in each of the device sides, is thereby rotated and causes the rear clamp pieces to move along the rods either forward or rearward. To prevent unauthorized loosening of the clamp device and its removal, two sliding bars in the front section of the device, are pushed outwards by lock action, so that the bars cover the sockets at the end the adjusting rods, closing access to the sockets.

A metal link is provided, joined to one sided of the clamp device for the purpose of attaching a chain or cable as may be desired for securing the PC to a table or desk. In addition, a "blocking" bar is provided for insertion in holes provided in the clamp device. The "blocking" bar may be used to prevent access to the PC disk drives when the front lock is locked.

Accordingly, it is a principal object of this invention to provide a device that will securely hold a PC housing in place, preventing its loss, while being easy for authorized persons to install and remove.

Another object is to provide a device that can be adapted to block access to a PC disk drive.

Other objects and advantages of the present invention will be apparent from study of the following specification, the claims and the drawings.

BRIEF DESCRIPTION OF THE DRAWINGS

FIG. 1 is a partial perspective view of a typical PC computer showing the preferred embodiment clamp lock installed and clamping the housing of the PC; also blocking access to a disk drive with a U-shaped blocking bar;

FIG. 2 is a plan view of the device, cut and with parts of the frame removed to show details of the clamp adjusting mechanism and locking mechanism;

FIG. 3 is a cross-section view of the right hand corner of the device taken along line 3—3 of FIG. 2 and particularly showing the threaded rod adjusting socket;

FIG. 4 is a cross-section view of part of the locking portion of the device, taken along line 4—4 of FIG. 2, and showing the slide bars and lock in the open position;

FIG. 4*a* is the same view as FIG. 4, but showing the front slide bars and lock in the closed position;

FIG. 5 is plan view of the front right-hand portion of the device, with the top of the frame removed to show detail of the inner parts; particularly showing the action of the slide bar in blocking access to the adjusting rod socket;

FIG. 5*a* is a plan view of a U-shaped blocking bar which is shown in FIG. 1 inserted in the clamp device and blocking access to the PC disk drive;

FIG. 6 is a perspective view of one of the rear clamp pieces, attached to a screw rod;

FIG. 7 is another partial perspective view of a PC having the preferred embodiment locked in place, and particularly showing the use of a rod blocking bar at the front instead of a U-shaped blocking bar; and FIG. 8 is a perspective of a back clamp bar which may be used to hold the device to the back of the PC housing, in place of the back clamp pieces shown in FIG. 2.

DESCRIPTION OF THE PREFERRED EMBODIMENT

Referring particularly to the drawings there is shown in FIG. 1 a partial perspective view of a Personal Computer (PC) 1 with the clamp lock device 2 of the present invention fastened in place. A U-shaped bar 4, which has been inserted in the device 2 at its front, acts to block access to the PC disk drive. A cylinder lock 18 at the front of the device 2 has been locked, causing the clamp adjustment through holes 20 at each end to be blocked. A ring 3 attached to the side of the clamp lock device 2, is used to attach a chain or cable for securing to a table or desk. The PC may be operated in this manner with the U-shaped bar 4 in place, or operated with the bar 4 removed, after unlocking the device through the cylinder lock 18.

The clamp lock device 2 is installed on the PC housing 1 by simply placing it around the PC, and tightening the rear clamp pieces to the PC back plate by use of a wrench or screwdriver inserted in each of the clamp adjustment holes 20. It can be removed in the same manner. There is no need to fasten screws into the PC housing or make any kind of permanent attachment to the PC.

Referring now to FIG. 2, there is shown a plan view of the clamp lock device 2 with parts of the frame top removed to show the mechanism. The device comprises a frame 8, clamp-adjusting means 10 and supports 12, clamp pieces 14, and locking means. The frame 8 is constructed from a metal channel material having a U-shaped cross-section, cut and bent to form a "U"

shape, and having a front 6 made flat and wide enough to fit snugly around a PC housing. The arms of the "U" are made long enough to project along the PC sides and beyond the back plane of the PC.

The clamp-adjusting means is provided by two threaded rods 10, one of which is located in each of the frame 8 arms, and supported by one or more screw support blocks 12. At the front end of each threaded rod 10 there is a socket 22 for a wrench or screwdriver. The socket 22 is shown in FIG. 3, which is a cross-section view of one corner taken along line 3—3 of FIG. 2. When a wrench is inserted in the socket 22 and rotated, the rotation of the threaded rod 10 which is fixed in place by support blocks 12, causes the attached back clamp piece 14 to move longitudinally along the rod 10, either forwards or backwards, depending on which way the socket 22 is rotated. Access to the sockets is provided by first and second access holes 20 in the front portion 6 of the frame 8, near the ends.

Locking means is provided by the combination of a cylinder lock 18, a right and a left slide bar, 16*a* and 16*b*, and two return springs 24. The action of the locking means is illustrated in FIGS. 4, 4*a* and 5. The cylinder lock 18 is located at the frame front portion 6 of the clamp lock 2, and set so that the lock 18 arms or projections, bear against the ends of the slide bars 16*a* and 16*b*, which can move longitudinally in the frame front 6. In FIG. 4, the lock 18 is open, and spring 24 pressure at the bar ends has caused the slide bars 16*a*, 16*b* to be held against the lock, leaving the socket access holes 20 unblocked. In FIG. 4*a*, the lock 18 is closed and the bars 6*a* and 16*b* are held outward, blocking the access holes 20 as shown in FIG. 5.

Refer now to FIG. 5*a*. This shows a U-shaped bar 4 which may be used as depicted in FIG. 1 to block access to a PC disk drive. A notch 7 is cut or formed in each leg of the "U" to provide a means of locking the bar in place. As shown in FIG. 2, two holes, third and fourth holes 5, are bored through the top front 6 of the frame 8; spaced apart to match the legs of the U-shaped bar 4 and sized to accommodate them. Also, two cutouts 26 are made in the right slide bar 16*b* as shown in FIG. 5. These cutouts 26 are sized and located so that they are directly under the third and fourth holes 5 in the frame 8. The cutouts 26 each have a flat left edge to fit into the notches 7 of the U-shaped bar 4. Thus, the U-shaped bar 4 is inserted through the frame holes 5 and through the cutouts 26. When the cylinder lock 18 is rotated to the locked position, the right slide bar 16*b* fits into the notches 7 in the U-shaped bar and locks it in place, preventing its removal from the frame 8.

FIG. 6 is a perspective view showing one of the rear clamp pieces 14 attached to a threaded rod 10. The clamp piece 14 is formed in a hook shape in order to fit over the back rim of the PC housing and bear against the back plate. These clamp pieces 14 may be replaced by a long clamp bar 30 shown in FIG. 8, depending on the need of the user. The clamp bar 30 would be connected to the ends of the threaded rods 10 through tapped holes 32 located near its ends. When the clamp bar 30 is installed, it crosses the PC back from one side to the other, crossing the row of computer card slots which are located at the back. Thus installation of the clamp bar 30 prevents unauthorized removal of any computer printed circuit cards through the slot openings.

Finally, FIG. 7 shows a use of the clamp lock device 2*a* where a blocking rod 28 is installed instead of the U-shaped blocking bar 4. The rod 28 may use either one of the holes 5 in the frame, and project through the frame bottom as well as the top. The rod 28 also has a notch cut out of its middle, similar to the notch 7 of the U-shaped blocking bar 4, to enable locking the rod in place. Thus, two of the disk drives can be blocked in this manner if so desired.

The alternate clamping and blocking elements described by the clamp bar 30 and blocking rod 28 are intended only for modifying the configuration shown in FIGS. 1 and 2 to suit a particular user's needs. The same general functions are served by the clamp pieces 14 and U-shaped bar 4, which act to hold the device tight against the PC housing and block use of the disk drive if necessary. Further, as an aid to fixing the device in a given position on the housing, adhesive means may be attached to the inside surface of the frame as desired.

From the foregoing description, it is believed that the preferred embodiment achieves the objects of the present invention. Alternative embodiments and modifications of the embodiment described herein will be apparent to those skilled in the art. These alternatives are considered to be equivalent and within the spirit and scope of the present invention.

What is claimed is:

1. A clamp locking device comprising:

a frame constructed from metal channel and formed to fit a PC, said frame having two parallel arms and a front portion, said parallel arms being made long enough to project along a PC housing side and beyond its back plane, said frame front portion being made long enough to enable said frame to fit snugly around a PC housing;

a clamp adjusting means mounted inside each arm of said frame;

a pair of clamp pieces, with each clamp piece operatively connected to said clamp adjusting means so as to be operated by said adjusting means, and projecting perpendicularly to said arms and in the plane of said arms; said clamp pieces mounted in a manner permitting longitudinal movement along said frame arms;

a disk drive blocking means, said blocking means including a blocking rod which is inserted vertically in the front portion of said frame when required to block access to the PC disk drive; said blocking means alternately including a U-shaped bar which may be inserted vertically in the front portion of said frame; and a locking means mounted inside the front of said frame, said locking means when open, permitting access to said clamp adjustment means for tightening or loosening said clamp pieces; said locking means when closed, holding said disk drive blocking means secured and preventing access to said clamp adjustment means.

2. A device as in claim 1 wherein:

said frame front portion has a first and second access hole in its front surface, each access hole being bored and located near the ends of said front portion, permitting access to the end of said clamp adjustment means.

3. A device as in claim 1 wherein:

said frame includes a metal ring fixedly secured to said frame, said metal ring for attachment of a chain or cable to secure the clamp locking device and thereby the PC to a desk or table.

4. A device as in claim 1 wherein:

said clamp adjusting means includes a threaded rod having a screw socket on its front end and one or more support blocks; said support blocks being fixedly secured in said frame arm, spaced along the length of said arm; said support blocks being bored in the longitudinal axis to accommodate and support said threaded rod along its length;

said clamp piece, which is connected to said threaded rod, being caused to move along said threaded rod when said rod is rotated by application of a suitable wrench or screwdriver to said screw socket.

5. A device as in claim 1 wherein:

said frame front portion has a third and fourth hole bored vertically through it, said holes being located on said frame front portion and spaced apart to accommodate the legs of said U-shaped blocking bar or said blocking pin.

6. A device as in claim 1 wherein:

said U-shaped bar has a notch cut in each of its legs to enable securing said bar in said frame.

7. A device as in claim 1 wherein:

said locking means includes a cylinder lock combined with a left slide bar, a right slide bar and two return springs; said cylinder lock being secured to said frame front portion, and having said left and right slide bars located to bear against said lock and against said return springs; said return springs, one spring each being seated in said frame at each end; said locking means being actuated by movement of a key in said cylinder lock, causing said lock projections to force said slide bars to slide in said frame front portion, a distance sufficient to impose said bars between said access holes for clamp adjustment and said screw sockets, thereby locking the clamp device in place.

8. A device as in claim 7 wherein:

said right slide bar has two cutout holes bored vertically through it; said cutout holes being spaced apart and located to fit directly under said third and fourth holes in said frame front portion when said right slide bar is assembled in said frame; said cutout holes each having a flat left edge to fit into and retain notches in said U-shaped blocking bar or said blocking rod.

9. A clamp locking device comprising:

a frame constructed from metal channel and formed to fit on a PC, said frame having two parallel arms and a front portion, said parallel arms being made long enough to project along a PC housing side and beyond its back plane, said frame front portion being made long enough to enable said frame to fit snugly around a PC housing;

a clamp adjusting means mounted inside each arm of said frame;

a back clamp bar, operatively connected to said clamp adjusting means so as to be operated by said adjusting means, and projecting perpendicularly to said arms and in the plane of said arms; said back clamp bar connected at its ends and permitting only longitudinal movement along said frame arms;

a disk drive blocking means, said blocking means including a blocking rod which is inserted vertically in the front portion of said frame when required to block access to the PC disk drive; said blocking means alternately including a U-shaped bar which may be inserted vertically in the front portion of said frame; and a locking means mounted inside the front of said frame, said locking means when open, permitting access to said clamp adjustment means for tightening or loosening said back clamp bar; said locking means when closed, holding said disk drive blocking means secured and preventing access to said clamp adjustment means.

10. A device as in claim 9 wherein:

said frame front portion has a first and second access hole in its front surface, each access hole being bored and located near the ends of said front portion, permitting access to the end of said clamp adjustment means.

11. A device as in claim 9 wherein:

said frame includes a metal ring fixedly secured to said frame, said metal ring for attachment of a chain or cable to secure the clamp locking device and thereby the PC to a desk or table.

12. A device as in claim 9 wherein:

said clamp adjusting means includes a threaded rod having a screw socket on its front end and one or more support blocks; said support blocks being fixedly secured in said frame arm, spaced along the length of said arm; said support blocks being bored in the longitudinal axis to accommodate and support said threaded rod along its length;

said back clamp bar, which is connected to said threaded rod, being caused to move along said threaded rod when said rod is rotated by application of a suitable wrench or screwdriver to said screw socket.

13. A device as in claim 9 wherein:

said frame front portion has a third and fourth hole bored vertically through it, said holes being located on the front portion and spaced apart to accommodate the legs of said U-shaped blocking bar or said blocking rod.

14. A device as in claim 9 wherein:

said locking means includes a cylinder lock combined with a left slide bar, a right slide bar and two return springs; said cylinder lock being secured to said frame front portion, and having said left and right slide bars located to bear against projections of said lock and against said return springs; said return springs, one spring each being seated in said frame at each end; said locking means being actuated by movement of a key in said cylinder lock, causing said lock projections to force said slide bars to slide in said frame front portion a distance sufficient to impose said bars between said access holes for clamp adjustment and said screw sockets, thereby locking the clamp device in place.

15. A device as in claim 14 wherein:

said right slide bar has two cutout holes bored vertically through it; said cutout holes being spaced apart and located to fit directly under said third and fourth holes in said frame front portion when said right slide bar is assembled in said frame; said cutout holes each having a flat left edge to fit into and retain notches in said U-shaped blocking bar or said blocking rod.

16. A device for blocking access to disk drives, said device comprising:

a frame constructed from metal channel;

a locking means mounted inside said frame; and a disk drive blocking means;

said frame having two holes bored vertically in it and located to accommodate said blocking means; said frame having adhesive means attached to one surface for attaching said frame to a PC housing;

said disk drive blocking means including a rod which is inserted vertically in said frame when required to block said disk drives; said blocking means also including a U-shaped bar which may be inserted vertically in said frame;

said locking means including a cylinder lock combined with a slide bar and return spring; said cylinder lock being fixedly secured to said frame, and having said slide bar located in said frame in a manner to bear against the projections of said lock and against said return spring; said slide bar having two cutout holes bored through it and spaced apart to accommodate the legs of said U-shaped blocking bar; said locking means being actuated by movement of a key in said cylinder lock, causing said lock projections to force said slide bar to slide in said frame a distance sufficient for the edge of each said cutout hole to engage and retain said blocking rod or said U-shaped blocking bar, locking it in place and blocking access to said disk drives.

* * * * *